US009312971B2

(12) United States Patent
Yoo et al.

(10) Patent No.: US 9,312,971 B2
(45) Date of Patent: Apr. 12, 2016

(54) APPARATUS AND METHOD FOR TRANSMITTING AUDIO OBJECT

(71) Applicant: Electronics and Telecommunications Research Institute, Daejeon (KR)

(72) Inventors: Jae Hyoun Yoo, Daejeon (KR); Jeong Il Seo, Daejeon (KR); Tae Jin Lee, Daejeon (KR); Keun Woo Choi, Seoul (KR); Kyeong Ok Kang, Daejeon (KR)

(73) Assignee: Electronics and Telecomunications Research Institute, Daejeon (KR)

( * ) Notice: Subject to any disclaimer, the term of this patent is extended or adjusted under 35 U.S.C. 154(b) by 456 days.

(21) Appl. No.: 13/729,303

(22) Filed: Dec. 28, 2012

(65) Prior Publication Data

US 2013/0170646 A1 Jul. 4, 2013

(30) Foreign Application Priority Data

Dec. 30, 2011 (KR) ..... 10-2011-0147536

(51) Int. Cl.

| | |
|---|---|
| ***H04R 5/00*** | (2006.01) |
| ***H04H 20/88*** | (2008.01) |
| ***G10L 19/008*** | (2013.01) |
| ***G10L 19/20*** | (2013.01) |
| *G10L 19/00* | (2013.01) |

(52) U.S. Cl.

CPC ..... *H04H 20/88* (2013.01); *G10L 19/008* (2013.01); *G10L 19/20* (2013.01); *G10L 19/00* (2013.01); *H04R 5/00* (2013.01); *H04S 2400/00* (2013.01); *H04S 2400/01* (2013.01); *H04S 2420/13* (2013.01)

(58) Field of Classification Search

CPC ..... G10L 19/008; G10L 19/20; G10L 19/00; H04H 20/88; H04N 5/04; H04N 21/4341; H04N 21/2368; H04N 5/00; H04R 3/12; H04R 5/00; H04S 7/30; H04S 2420/13; H04S 2400/01; H04S 2400/00

USPC ..... 381/22, 2, 20, 17, 18, 19, 23, 21, 1, 381/310, 306, 56, 58; 700/94; 704/219, 704/226, E19.001, 500, 504; 375/240.18; 382/190, 154

See application file for complete search history.

(56) References Cited

U.S. PATENT DOCUMENTS

| | | | | |
|---|---|---|---|---|
| 5,649,052 | A * | 7/1997 | Kim | 704/226 |
| 7,136,812 | B2 * | 11/2006 | Manjunath et al. | 704/221 |
| 2003/0084277 | A1 * | 5/2003 | Przywara et al. | 713/1 |
| 2007/0291951 | A1 * | 12/2007 | Faller | 381/22 |

(Continued)

FOREIGN PATENT DOCUMENTS

WO 2009036883 A1 3/2009

*Primary Examiner* — Xu Mei
*Assistant Examiner* — Ubachukwu Odunukwe
(74) *Attorney, Agent, or Firm* — William Park & Associates Ltd.

(57) ABSTRACT

An apparatus and method for transmitting a plurality of audio objects using a multichannel encoder and a multichannel decoder are provided. The audio object encoder includes a multichannel encoder determination unit to determine a multichannel encoder to be used for encoding of a plurality of audio objects according to the number of the audio objects, an encoding unit to generate an encoded signal by encoding the plurality of audio objects using the determined multichannel encoder, and a multichannel audio object signal generation unit to generating a multichannel audio object signal, by multiplexing sound image localization information of the plurality of audio objects along with the encoded signal.

21 Claims, 6 Drawing Sheets

(56) References Cited

U.S. PATENT DOCUMENTS

2009/0222261 A1* 9/2009 Jung et al. ..... 704/219
2011/0002393 A1* 1/2011 Suzuki et al. ..... 375/240.18
2011/0002469 A1* 1/2011 Ojala ..... 381/22

* cited by examiner

APPARATUS AND METHOD FOR TRANSMITTING AUDIO OBJECT

CROSS-REFERENCE TO RELATED APPLICATION

This application claims the benefit of Korean Patent Application No. 10-2011-0147536, filed on Dec. 30, 2011, in the Korean Intellectual Property Office, the disclosure of which is incorporated herein by reference.

BACKGROUND

1. Field of the Invention

The present invention relates to an apparatus and method for transmitting a plurality of audio objects using a multichannel encoder and a multichannel decoder, and more particularly, to an audio object transmission apparatus and method for conveniently transmitting a plurality of audio objects by encoding the plurality of audio objects using a multichannel encoder.

2. Description of the Related Art

A wave field synthesis (WFS) reproduction scheme refers to a technology for providing the same sound field to several listeners in a listening space by synthesizing a wave front of a sound source to be reproduced.

According to the WFS reproduction scheme, a large number of audio objects are necessary for a single audio scene. However, since a transmission medium that transmits a WFS signal has a limited bandwidth, a degree of difficulty in transmission of the audio objects may increase according to an increase in the number of the audio objects.

Recently, the moving picture expert group (MPEG) has developed a method for transmitting a large number of objects using spatial audio object coding (SAOC). However, the SAOC uses a dedicated codec. That is, an additional codec needs to be implemented.

Accordingly, there is a desire for a new secure scheme and method for transmitting a plurality of audio objects without having to implementing an additional codec.

SUMMARY

An aspect of the present invention provides an apparatus and method for conveniently transmitting a plurality of audio objects.

Another aspect of the present invention provides an apparatus and method for encoding a large number of audio objects using a conventional multichannel encoder.

According to an aspect of the present invention, there is provided an audio object encoder including a multichannel encoder determination unit to determine a multichannel encoder to be used for encoding of a plurality of audio objects according to the number of the audio objects, an encoding unit to generate an encoded signal by encoding the plurality of audio objects using the determined multichannel encoder, and a multichannel audio object signal generation unit to generating a multichannel audio object signal, by multiplexing sound image localization information of the plurality of audio objects along with the encoded signal.

According to another aspect of the present invention, there is provided an audio object decoder including a signal extraction unit to extract sound image localization information and an encoded signal of a plurality of audio objects from a multichannel audio object signal being received, a decoding unit to restore the plurality of audio objects by decoding the encoded signal using at least one multichannel decoder, and a rendering unit to perform wave field synthesis (WFS) rendering with respect to the plurality of audio objects using the sound image localization information.

According to another aspect of the present invention, there is provided an audio object transmission apparatus including an audio object encoder that transmits a plurality of audio objects by encoding the plurality of audio objects using a multichannel encoder, and an audio object decoder that restores the plurality of audio objects by decoding a received signal using a multichannel decoder.

According to another aspect of the present invention, there is provided an audio object encoding method including determining a multichannel encoder to be used for encoding of a plurality of audio objects according to the number of the plurality of audio objects, generating an encoded signal by encoding the plurality of audio objects using the determined multichannel encoder, and generating a multichannel audio object signal by multiplexing sound image localization information of the plurality of audio objects along with the encoded signal.

According to another aspect of the present invention, there is provided an audio object decoding method including extracting sound image localization information and an encoded signal of a plurality of audio objects from a multichannel audio object signal being received, restoring the plurality of audio objects by decoding the encoded signal using at least one multichannel decoder, and performing WFS rendering with respect to the plurality of audio objects using the sound image localization information.

EFFECT

According to embodiments of the present invention, a plurality of audio objects may be transmitted conveniently, by encoding the plurality of audio objects using a multichannel encoder.

Additionally, according to embodiments of the present invention, in a case that the audio objects are large in number, a plurality of multichannel encoders may be used in parallel. Therefore, audio objects larger in number than channels covered by a conventional multichannel encoder may be simultaneously encoded.

BRIEF DESCRIPTION OF THE DRAWINGS

These and/or other aspects, features, and advantages of the invention will become apparent and more readily appreciated from the following description of exemplary embodiments, taken in conjunction with the accompanying drawings of which.

DETAILED DESCRIPTION

Figure 1:
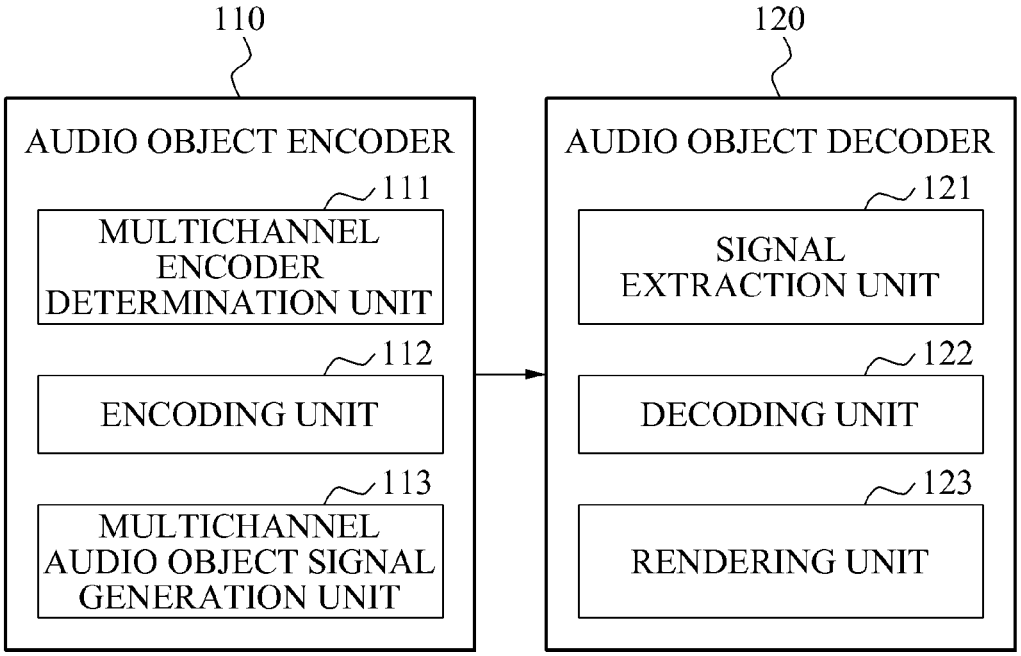
FIG. 1 is a block diagram illustrating an audio object transmission apparatus according to an embodiment of the present invention.

Reference will now be made in detail to exemplary embodiments of the present invention, examples of which are illustrated in the accompanying drawings, wherein like reference numerals refer to the like elements throughout. Exemplary embodiments are described below to explain the present invention by referring to the figures.

FIG. 1 is a block diagram illustrating an audio object transmission apparatus according to an embodiment of the present invention.

The audio object transmission apparatus may include an audio object encoder 110 which encodes audio objects using a multichannel encoder and transmits the audio objects in a wave field synthesis (WFS) system based on an audio object signal, and an audio object decoder 120 which restores the audio objects using a multichannel decoder.

Referring to FIG. 1, the audio object encoder 110 may include a multichannel encoder determination unit 111, an encoding unit 112, and a multichannel audio object signal generation unit 113.

The multichannel encoder determination unit 111 may determine a multichannel encoder to be used in encoding audio objects based on the number of the audio objects. Here, the audio objects may be adapted to generate a 3-dimensional (3D) effect sound source. For example, the audio objects may include objects generating a sound such as a train and an animal, and objects representing a place of a natural phenomenon such as a lightning.

For example, when the audio objects are six in number, the multichannel encoder determination unit 111 may determine a 5.1 channel encoder that uses six channels as the multichannel encoder to be used for encoding of the audio objects. When the audio objects are eight, the multichannel encoder determination unit 111 may determine a 7.1 channel encoder that uses eight channels as the multichannel encoder to be used for encoding of the audio objects.

When the audio objects are larger in number than channels of the multichannel encoder, the multichannel encoder determination unit 111 may determine a plurality of multichannel encoders as the multichannel encoder to be used for encoding of the audio objects.

For example, when the audio objects are twelve in number, the multichannel encoder determination unit 111 may determine a 10.2 channel encoder that uses twelve channels as the multichannel encoder to be used for encoding of the audio objects. However, in a case where the encoding unit 112 has only the 5.1 channel encoder and the 7.1 channel encoder, the encoding unit 112 is unable to encode the audio objects using a 10.2 channel encoder.

In this case, the multichannel encoder determination unit 111 may determine to use two 5.1 channel encoders as the multichannel encoder to be used for encoding of the audio objects, thus encoding the twelve audio objects.

The encoding unit 112 may encode the audio objects using the multichannel encoder determined by the multichannel encoder determination unit 111, thereby generating an encoded signal.

In addition, when the multichannel encoder determination unit 111 determines the plurality of multichannel encoders as the multichannel encoder to be used for encoding of the audio objects, the encoding unit 112 may use the plurality of multichannel encoders in a parallel manner so that the audio objects are simultaneously encoded.

The multichannel audio object signal generation unit 113 may multiplex sound image localization information of the audio objects along with the encoded signal, thereby generating a multichannel audio object signal. Here, the sound image localization information may be information related to an orientation and a distance of the respective audio objects. The multichannel audio object signal generation unit 113 may be a multiplexer (MUX) adapted to output a plurality of signals as a single signal.

The multichannel audio object signal generation unit 113 may add, to the multichannel audio object signal, encoder information which includes information on a type and number of the multichannel encoder determined by the multichannel encoder determination unit 111.

Thus, the audio object encoder 110 according to the present embodiment may conveniently transmit the plurality of audio objects, by encoding the plurality of audio objects by a multichannel encoder. Furthermore, when the number of the audio objects is relatively large, the audio object encoder 110 may simultaneously encode the audio objects larger in number than channels covered by a conventional multichannel encoder.

Referring to FIG. 1, the audio object decoder 120 may include a signal extraction unit 121, a decoding unit 122, and a rendering unit 123.

The signal extraction unit 121 may extract the sound image localization information and the encoded signal of the audio objects from the multichannel audio object signal received from the audio object encoder 110. The signal extraction unit 121 may be a demultiplexer (DEMUX) that receives a single signal and outputs a plurality of signals.

Additionally, the signal extraction unit 121 may further extract the encoder information which includes the information on a type and number of the multichannel encoder used for encoding in the received multichannel audio object signal.

The decoding unit 122 may decode the encoded signal by at least one multichannel decoder, thereby restoring the plurality of audio objects.

The decoding unit 122 may decode the audio objects using the at least one multichannel decoder according to encoder information. When the multichannel encoder is plural in number according to the encoder information, the decoding unit 122 may use the at least one multichannel decoder according to the encoder information in a parallel manner, thereby decoding the plurality of audio objects simultaneously.

The rendering unit 123 may perform WFS rendering with respect to the audio objects using the sound image localization information.

Specifically, the rendering unit 123 may perform WFS rendering by receiving user environment information and using the sound image localization information corresponding to the user environment information. Here, the user environment information may be related to a number and positions of loud speakers.

Figure 2:
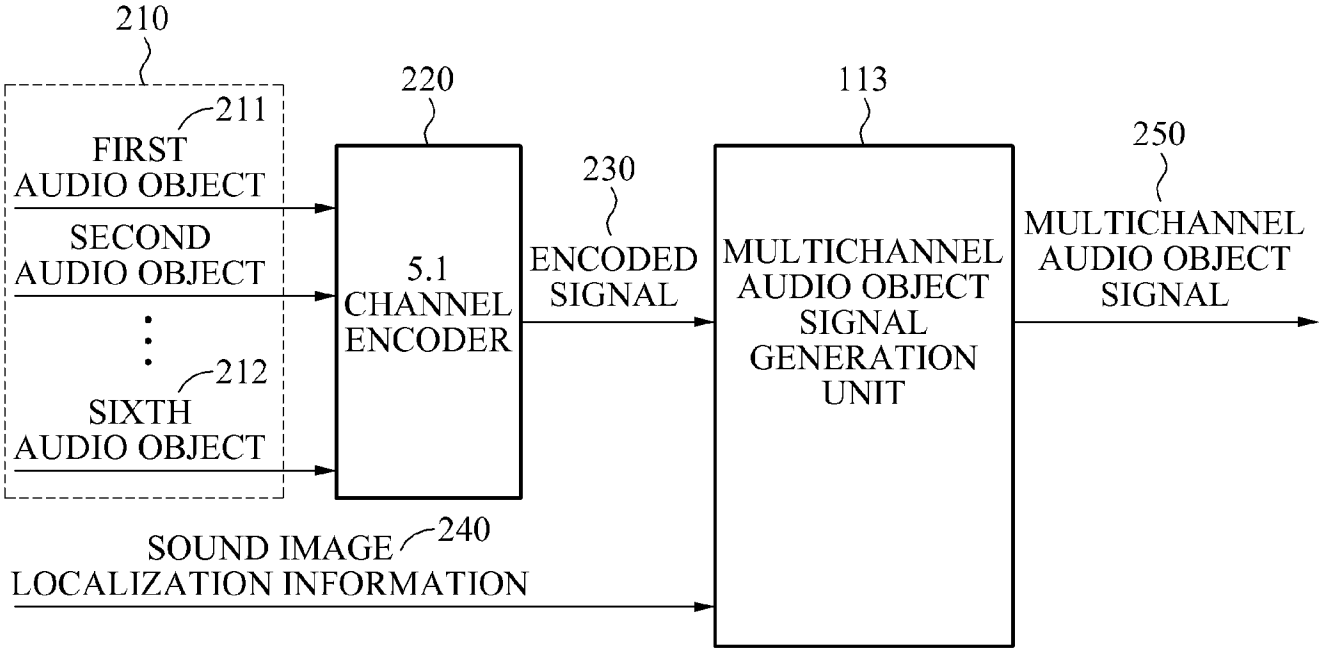
FIG. 2 is a diagram illustrating a process of encoding audio objects by an audio object encoder according to an embodiment of the present invention.

FIG. 2 is a diagram illustrating a process of encoding audio objects by an audio object encoder 110 according to an embodiment of the present invention.

When audio objects 210 are six in number as shown in FIG. 2, the audio object encoder 110 may encode the six audio objects 210 using a 5.1 channel encoder 220 that uses six channels, thereby generating an encoded signal 230.

Here, a multichannel audio object signal generation unit 113 of the audio object encoder 110 may multiplex sound image localization information 240 of the audio objects 210 along with the encoded signal 230, thereby generating a multichannel audio object signal 250. The sound image localization information may be information related to an orientation and a distance of each of a first audio object 211 to a sixth audio object 212. The multichannel audio object signal generation unit 113 may add encoder information representing that a single 5.1 channel encoder is used, to the multichannel audio object signal 250.

Figure 3:
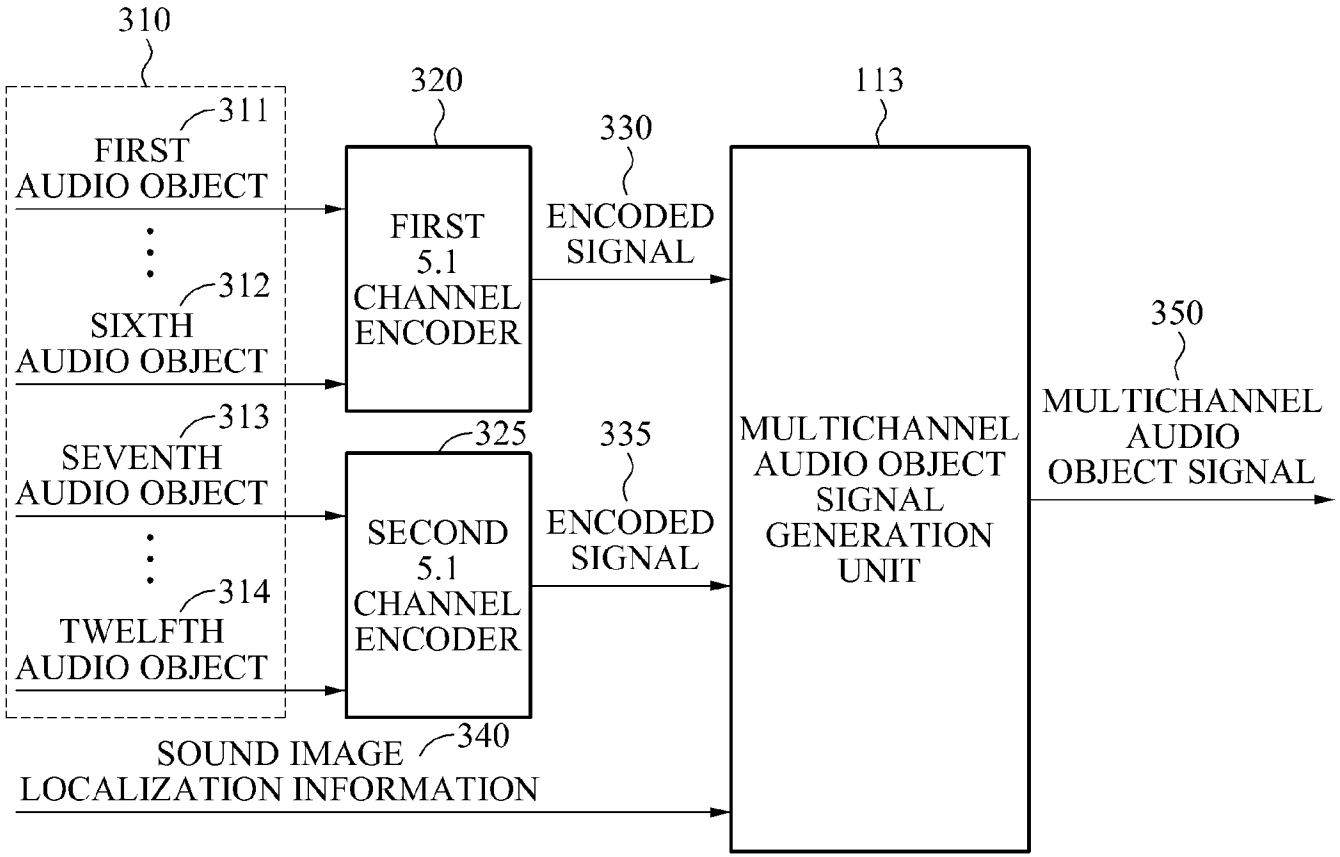
FIG. 3 is a diagram illustrating a process of encoding audio objects by an audio object encoder according to another embodiment of the present invention.

FIG. 3 is a diagram illustrating a process of encoding audio objects by an audio object encoder 110 according to another embodiment of the present invention.

When audio objects 310 are twelve in number as shown in FIG. 3, the audio object encoder 110 may encode the twelve audio objects 310 using two 5.1 channel encoders, that is, a first 5.1 channel encoder 320 and a second 5.1 channel encoder 325 each using six channels, thereby generating encoded signals 330 and 335.

A decoding unit 112 of the audio object encoder 110 may use the first 5.1 channel encoder 320 and the second 5.1 channel encoder 325 in a parallel manner as shown in FIG. 3, thereby encoding the twelve audio objects 310 simultaneously. The first 5.1 channel encoder 320 may encode a first audio object 311 to a sixth audio object 312, thereby generating the encoded signal 330. The second 5.1 channel encoder 325 may encode a seventh audio object 313 to a twelfth 314 audio object 314, thereby generating the encoded signal 335.

A multichannel audio object signal generation unit 113 of the audio object encoder 110 may multiplex sound image localization information 340 of the audio objects 310 along with the encoded signals 330 and 335, thereby generating a multichannel audio object signal 350. The multichannel audio object signal generation unit 113 may add encoder information representing that two single 5.1 channel encoders are used, to the multichannel audio object signal 350.

That is, the audio object encoder 110 may simultaneously encode twelve audio objects without a 10.2 channel encoder, by using conventional 5.1 channel encoders in a parallel manner.

Figure 4:
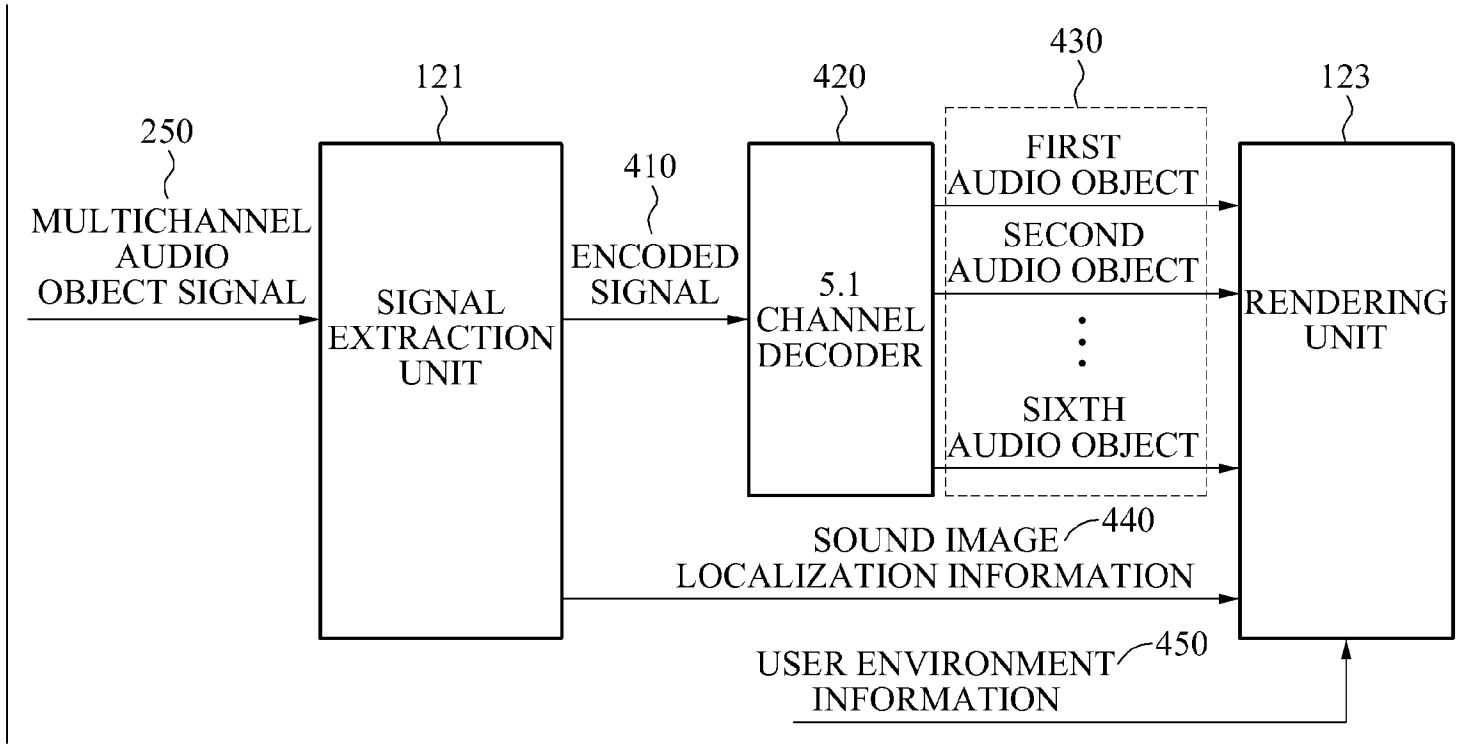
FIG. 4 is a diagram illustrating a process of decoding audio objects by an audio object decoder according to an embodiment of the present invention.

FIG. 4 is a diagram illustrating a process of decoding audio objects by an audio object decoder 120 according to an embodiment of the present invention.

A signal extraction unit 121 of the audio object decoder 120 may extract an encoded signal 410 and sound image localization information 440 of the audio objects from a multichannel audio object signal 250 received from an audio object encoder 110. The signal extraction unit 121 may further extract encoder information representing that a 5.1 channel encoder is used, from the multichannel audio object signal 250.

As shown in FIG. 4, a decoding unit 122 of the audio object decoder 120 may decode the encoded signal 410 using a 5.1 channel decoder 420 corresponding to the encoder information, thereby restoring six audio objects 430.

At last, the rendering unit 123 may perform WFS rendering with respect to the audio objects 430 using the sound image localization information 440.

Here, the rendering unit 123 may receive user environment information 450, and perform WFS rendering using the sound image localization information 440 according to the user environment information 450. Here, the user environment information 450 may be related to a number and positions of loud speakers.

Figure 5:
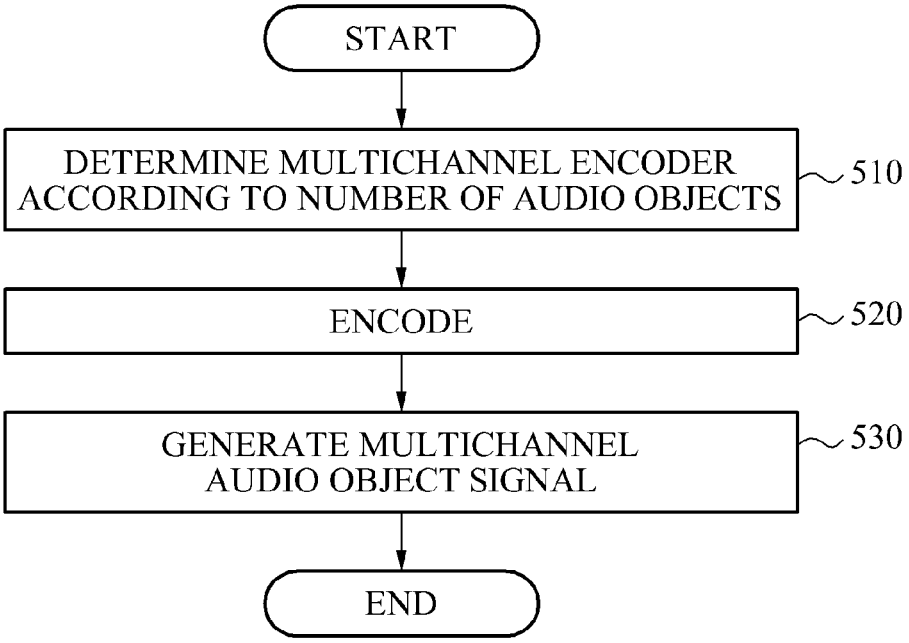
FIG. 5 is a flowchart illustrating an audio object encoding method according to an embodiment of the present invention.

FIG. 5 is a flowchart illustrating an audio object encoding method according to an embodiment of the present invention.

In operation 510, a multichannel encoder determination unit 111 may determine a multichannel encoder to be used for encoding of audio objects, according to the number of the audio objects. When the number of the audio objects is larger than the number of channels of a multichannel encoder usable by an encoding unit 112, the multichannel encoder determination unit 111 may determine a plurality of multichannel encoders as the multichannel encoder to be used for encoding of the audio objects.

In operation 520, the encoding unit 112 may generate an encoded signal by encoding the audio objects by the multichannel encoder determined in operation 510.

In operation 530, the multichannel audio object signal generation unit 113 may generate a multichannel audio object signal, by multiplexing sound image localization information of the audio objects along with the encoded signal generated in operation 520.

Figure 6:
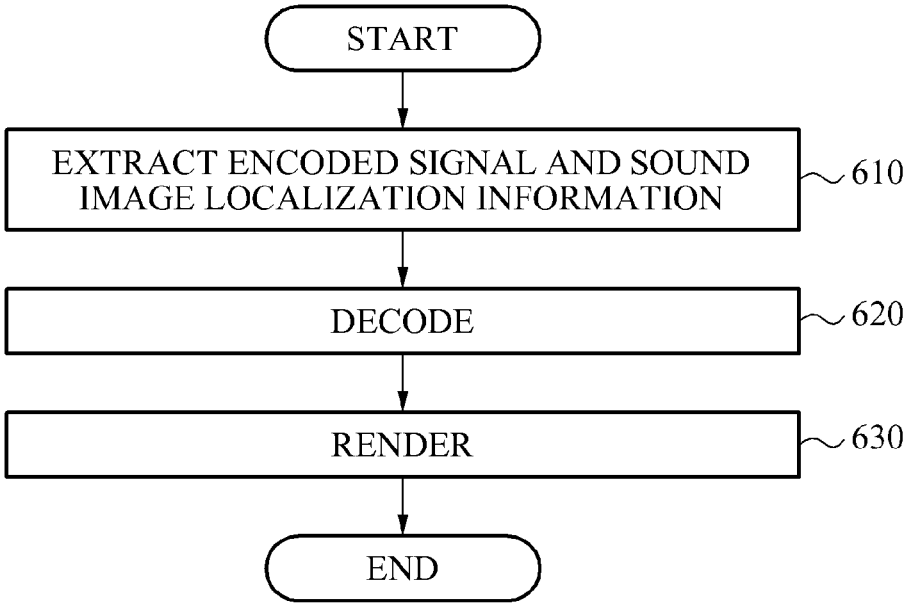
FIG. 6 is a flowchart illustrating audio object decoding method according to an embodiment of the present invention.

FIG. 6 is a flowchart illustrating an audio object decoding method according to an embodiment.

In operation 610, a signal extraction unit 121 may extract an encoded signal and sound image localization information of audio objects from a multichannel audio object signal received from an audio object encoder 110. The signal extraction unit 121 may further extract encoder information representing that a 5.1 channel encoder is used, from the multichannel audio object signal.

In operation 620, a decoding unit 122 may decode the encoded signal extracted in operation 610 by a multichannel decoder corresponding to the encoder information extracted in operation 610, thereby restoring the audio objects.

In operation 630, the rendering unit 123 may perform WFS rendering with respect to the audio objects restored in operation 620 using sound image localization information 440 extracted in operation 610.

According to the embodiments, a plurality of audio objects may be conveniently transmitted by encoding the plurality of audio objects by a multichannel encoder. When the audio objects are large in number, a plurality of the multichannel encoders may be used in parallel. That is, the plurality of audio objects larger in number than channels covered by a conventional multichannel encoder may be encoded simultaneously.

Although a few exemplary embodiments of the present invention have been shown and described, the present invention is not limited to the described exemplary embodiments.

Instead, it would be appreciated by those skilled in the art that changes may be made to these exemplary embodiments without departing from the principles and spirit of the invention, the scope of which is defined by the claims and their equivalents.

What is claimed is:

1. An audio object encoder apparatus comprising:

a multichannel encoder determination unit to determine a multichannel surround sound encoder to be used for encoding a plurality of audio objects when the number of audio objects is accommodated by the number of channels of the multichannel surround sound encoder;

the multichannel encoder determination unit to determine a plurality of the multichannel surround sound encoders to be used for encoding the plurality of audio objects when the number of audio objects is greater than the number of channels of the multichannel surround sound encoder;

an encoding unit to generate an encoded signal by encoding the plurality of audio objects using the determined plurality of multichannel surround sound encoders in a parallel manner; and a multichannel audio object signal generation unit to generate a multichannel audio object signal, by multiplexing sound image localization information of the plurality of audio objects along with the encoded signal.

2. The audio object encoder apparatus of claim 1, wherein the multichannel encoder determination unit determines the number of multichannel surround sound encoders to be used based on the combined number of channels of the multichannel surround sound encoders needed to accommodate the number of audio objects.

3. The audio object encoder apparatus of claim 1, wherein the multichannel surround sound encoders are of the same type.

4. The audio object encoder apparatus of claim 1, wherein the multichannel audio object signal generation unit adds, to the multichannel audio object signal, encoder information which includes information comprising a type and number of the determined multichannel surround sound encoders.

5. An audio object decoder apparatus comprising:

a signal extraction unit to extract sound image localization information and an encoded signal of a plurality of audio objects from a multichannel audio object signal being received;

a decoding unit to restore the plurality of audio objects by decoding the encoded signal using a selected multichannel surround sound decoder indicated from received information and having a number of channels accommodating the number of audio objects;

the decoding unit to restore the plurality of audio objects by decoding the encoded signal using a plurality of selected multichannel surround sound decoders in a parallel manner when the number of audio objects is greater than the number of channels of a multichannel surround sound decoder, indicated from the received information; and a rendering unit to perform wave field synthesis (WFS) rendering with respect to the plurality of audio objects using the sound image localization information.

6. The audio object decoder apparatus of claim 5, wherein the signal extraction unit further extracts encoder information which includes the received information comprising a type and number of multichannel surround sound encoders used for encoding in the received multichannel audio object signal.

7. The audio object decoder apparatus of claim 5, wherein the multichannel surround sound decoders are of the same type.

8. The audio object decoder apparatus of claim 5, wherein the rendering unit performs wave field synthesis (WFS) rendering with respect to the plurality of audio objects using the sound image localization information according to user environment information.

9. The audio object decoder apparatus of claim 8, wherein the user environment information is related to a number and/or positions of loud speakers.

10. An audio object communication apparatus comprising:

an audio object encoder that transmits a plurality of audio objects by encoding the plurality of audio objects using a selected multichannel surround sound encoder when the number of audio objects is accommodated by the number of channels of the selected multichannel surround sound encoder, and using in a parallel manner a selected plurality of the multichannel surround sound encoders when the number of audio objects is greater than the number of channels of the multichannel surround sound encoder; and an audio object decoder that restores the plurality of audio objects by decoding a received signal using a selected multichannel surround sound decoder indicated from received information and having a number of channels accommodating the number of audio objects, and using in a parallel manner a selected plurality of the multichannel surround sound decoders when the number of audio objects is greater than the number of channels of a multichannel surround sound decoder, indicated from the received information.

11. An audio object encoding method comprising:

determining a surround sound encoder to be used for encoding a plurality of audio objects when the number of audio objects is accommodated by the number of channels of the multichannel surround sound encoder;

determining a plurality of the multichannel surround sound encoders to be used for encoding the plurality of audio objects when the number of audio objects is greater than the number of channels of the multichannel surround sound encoder;

generating an encoded signal by encoding the plurality of audio objects using the determined plurality of multichannel surround sound encoders in a parallel manner; and generating a multichannel audio object signal by multiplexing sound image localization information of the plurality of audio objects along with the encoded signal.

12. The audio object encoding method of claim 11, wherein the determining of the plurality of the multichannel surround sound encoders comprises determining the number of multichannel surround sound encoders to be used based on the combined number of channels of the multichannel surround sound encoders needed to accommodate the number of audio objects.

13. The audio object encoding method of claim 11, wherein the multichannel surround sound encoders are of the same type.

14. The audio object encoding method of claim 11, wherein the generating of the multichannel audio object signal comprises adding, to the multichannel audio object signal, encoder information which includes information comprising a type and number of the determined multichannel surround sound encoders.

15. An audio object decoding method comprising:

extracting sound image localization information and an encoded signal of a plurality of audio objects from a multichannel audio object signal being received;

restoring the plurality of audio objects by decoding the encoded signal using a selected multichannel surround sound decoder indicated from received information and having a number of channels accommodating the number of audio objects;

restoring the plurality of audio objects by decoding the encoded signal using a plurality of selected multichannel surround sound decoders in a parallel manner when the number of audio objects is greater than the number of channels of a multichannel surround sound decoder, indicated from the received information; and performing wave field synthesis (WFS) rendering with respect to the plurality of audio objects using the sound image localization information.

16. The audio object decoding method of claim 15, wherein the extracting comprises further extracting encoder information which includes the received information comprising a type and number of multichannel surround sound encoders used for encoding in the received multichannel audio object signal.

17. The audio object decoding method of claim 16, wherein the multichannel surround sound decoders are of the same type.

18. The audio object decoding method of claim 15, wherein the rendering comprises performing wave field synthesis (WFS) rendering with respect to the plurality of audio objects using the sound image localization information according to user environment information.

19. The audio object decoding method of claim 18, wherein the user environment information is related to a number and/or positions of loud speakers.

20. The audio object encoder apparatus of claim 1, wherein the multichannel surround sound encoders are implemented in the same codec.

21. An audio object encoder apparatus comprising:

a multichannel encoder determination unit to determine a multichannel surround sound encoder to be used for encoding a plurality of audio objects when the number of audio objects is accommodated by the number of channels of the multichannel surround sound encoder;

the multichannel encoder determination unit to determine a plurality of the multichannel surround sound encoders to be used for encoding the plurality of audio objects when the number of audio objects is greater than the number of channels of the multichannel surround sound encoder;

an encoding unit to generate an encoded signal by encoding the plurality of audio objects using the determined multichannel surround sound encoder when the number of audio objects is accommodated by the number of channels of the multichannel surround sound encoder;

the encoding unit to generate an encoded signal by encoding the plurality of audio objects using the determined plurality of multichannel surround sound encoders in a parallel manner when the number of audio objects is greater than the number of channels of the multichannel surround sound encoder; and a multichannel audio object signal generation unit to generate a multichannel audio object signal, by multiplexing sound image localization information of the plurality of audio objects along with the encoded signal.

* * * * *